US007381227B2

(12) United States Patent
Parker

(10) Patent No.: US 7,381,227 B2
(45) Date of Patent: Jun. 3, 2008

(54) FABRIC LAUNDERING

(75) Inventor: Andrew Philip Parker, Wirral (GB)

(73) Assignee: Conopco, Inc., Englewood Cliffs, NJ (US)

( * ) Notice: Subject to any disclaimer, the term of this patent is extended or adjusted under 35 U.S.C. 154(b) by 218 days.

(21) Appl. No.: 11/217,781

(22) Filed: Sep. 1, 2005

(65) Prior Publication Data

US 2006/0052271 A1 Mar. 9, 2006

(30) Foreign Application Priority Data

Sep. 4, 2004 (GB) ..... 0419689.5

(51) Int. Cl.

| | |
|---|---|
| ***D06L 1/02*** | (2006.01) |
| ***C11D 1/83*** | (2006.01) |
| ***C11D 3/18*** | (2006.01) |
| ***C11D 3/22*** | (2006.01) |

(52) U.S. Cl. ..... 8/137; 510/347; 510/470; 510/473; 424/488; 424/495; 424/498

(58) Field of Classification Search ..... 510/347, 510/470, 473; 8/137; 424/488, 495, 498
See application file for complete search history.

(56) References Cited

U.S. PATENT DOCUMENTS

| | | | | |
|---|---|---|---|---|
| 3,242,092 | A | 3/1966 | Bechtold | |
| 4,056,481 | A | 11/1977 | Tate | |
| 5,601,746 | A | 2/1997 | Danner et al. | |
| 5,849,278 | A * | 12/1998 | Piot et al. | 424/70.7 |
| 5,985,255 | A | 11/1999 | Vanlerberghe et al. | |
| 2002/0107169 | A1* | 8/2002 | Whilton | 510/510 |
| 2004/0102354 | A1 | 5/2004 | Fack et al. | |

FOREIGN PATENT DOCUMENTS

| | | |
|---|---|---|
| DE | 44 41 029 | 5/1996 |
| GB | 1 533 118 | 11/1978 |
| WO | 96/16147 | 5/1996 |
| WO | 98/29528 | 7/1998 |
| WO | 99/14295 | 3/1999 |
| WO | 99/61479 | 12/1999 |
| WO | 00/65015 | 11/2000 |
| WO | 2004/046295 | 6/2004 |

OTHER PUBLICATIONS

International Search Report, PCT/EP2005/008862, mailed Oct. 31, 2005—2 pp.
GB Search Report, GB 0419689.5, dated Feb. 18, 2005—1 p.

* cited by examiner

*Primary Examiner*—Brian P Mruk
(74) *Attorney, Agent, or Firm*—Alan A. Bornstein

(57) ABSTRACT

Relatively low levels of polysaccharides in combination with small, deformable, water-insoluble particles of a size in the range 0.05-5 microns are capable of giving benefits in a wash liquor in terms of reduced fabric abrasion.

3 Claims, No Drawings

FABRIC LAUNDERING

TECHNICAL FIELD

The present invention relates to improved products and processes for fabric laundering.

BACKGROUND OF THE INVENTION

Most people are aware that washing and wearing clothes is not good for them. Clothes suffer damage due to abrasion in the wash, particularly around seams and hems. On dark cellulosics (such as black or navy 'jeans', for example) this damage exposes fibrillated regions of the textile which scatter light differently than undamaged regions.

While the damaged regions may have lost relatively small quantities of dye, they are very easy to perceive and produce a strong visual impact. It has been suggested to reduce the incidence of such damage by using lubricating agents in wash liquors. However the skilled worker is faced with a problem when asked to choose the right lubricant. Prior proposals have included acrylic materials, dextrans, oily and waxy materials.

Hydroxy ethyl cellulose (HEC) is widely commercially available and is well known as a viscosity modifier in a range of surfactant-containing products as well as in paints and other coatings. It is generally produced by the treatment of cellulose with ethylene oxide to give materials with a specified degree of substitution of the hydroxyl groups of the glucose rings with hydroxy ethyl groups. Related materials are known which comprise other short alkyl chains (typically C2-4). Other known materials are hydroxy-alkyl derivatives of other beta 1-4 linked poly-saccharrides.

In order to bring about viscosity changes cellulose ethers are generally required to be present at levels of 1-2% wt on liquor, depending on the molecular weight of the polymer. It is known that bulk viscosity increases in a wash liquor can have beneficial effects on fabrics being laundered, as the increase in viscosity reduces certain fabric-fabric interactions which can cause degradation of the fabrics through such mechanisms as abrasion etc. However, viscosity increases have negative consequences as well. They can significantly reduce cleaning.

WO 99/61479 discloses the use of hydrophobically modified cellulose ether in, for example, detergents.

WO 00/65015 discloses the use of cellulose-ether as a finishing agent, which is replenished during washes.

WO 98/29528 discloses the use of 0.1-8% wt of modified cellulose ether, which 'associates with the fibres of the fabric being laundered' and 'reduces the tendency of the fabrics to deteriorate in appearance'.

BRIEF DESCRIPTION OF THE INVENTION

We have now determined that relatively low levels of polysaccharides in combination with small, deformable, water insoluble particles, are capable of giving benefits in a wash liquor in terms of reduced fabric abrasion.

Accordingly, the present invention provides a method of treating fabrics with a wash liquor which comprises:

a) a polysaccharide, b) deformable, water-insoluble particles of a size in the range 0.05-0.5 microns The method is preferably applied to coloured fabrics with a luminance (L*) less than 50 in a wash liquor, more preferably to black fabric articles.

Typically, the wash liquor comprises 0.0.01-0.1 g/L of the polysaccharide.

The invention also provides a washing composition comprising:

a) a polysaccharide, and, b) deformable, water-insoluble particles of a size in the range 0.05-0.5 microns.

Luminance (also known as lightness) is the measure of the brightness of a surface on a black-white scale. It is one of the triplet of independent measurements, the other two being chroma (C*, which measures saturation) and hue (H*, which measures chromatic tone), which can be used to characterize any colour by locating it in a 'colour space'. Changes in these three values can be combined to give the well known measure 'delta E' which is often used to determine the change in colour of an article when it is washed.

In this specification the colour space used as a referent is the CIELAB (International Lighting Commission) system, also known as the CIE 1976 colour space. This is an internationally recognized standard. When L* is 0 the surface being considered is black. When L* is 100, the surface is a white standard. Such a white standard is supplied for use with the Datacolor™ Spectraflash SF600+reflectance spectrometer.

Colours with luminance (L*) less than 50 are also known herein as 'Class 3' colours. There are three sets of Class 3 colours—high chroma (C*), saturated colours such as bright purple, and intense blue, low chroma muted tones such as browns and olives and those with little or no chroma e.g. black/dark grey. Class 3 colours are very sensitive to fading. Uneven colour changes occur very readily on Class 3 colours because the lightness differences between areas are large and thus particularly amenable to human perception.

While not wishing to limit the scope of the invention by reference to a theory of operation, it is believed that the particles, which have a low tendency to abrade due to their deformable nature (and are typically rounded in shape) lubricate the relative movement of fabric fibres (which are typically cellulosic) and are held in place by the polysaccharide.

Preferably the polysaccharide is a beta 1-4 polysaccharide; more preferably a cellulose derivative. Cellulose derivatives are widely available and many show excellent cellulose self recognition.

Preferably the polysaccharide is a hydroxy C2-C4 alkyl derivative. Preferably the hydroxy C2-C4 alkyl derivative is a hydroxy ethyl derivative.

In a preferred embodiment the polysaccharide is the hydroxy-alkyl ether of cellulose. This material is not only commonly available, but also shows excellent lubrication benefits.

Preferably the degree of substitution (DS) of the polysaccharide is 1-3, more preferably 1.5-2.25. Most preferably the DS falls in the range 1.5-2.0. Lower DS levels have poor water solubility, which appears to be important for the lubricating effect. Higher levels appear to lead to problems with particulate soil redeposition.

Preferably the molecular weight of the polysaccharide is 100,000 to 500,000 Dalton, preferably less than 300,000 Dalton. The polysaccharide is preferably such that viscosity of the material is 300-400 cps at 2% solution (measured on a Brookfield viscometer using ASTM D2364). The solution viscosity under standard conditions is related to the molecular weight of the polysaccharide, and the preferred materials have nearly Newtonian viscosity profiles between 1 and 10 reciprocal seconds.

Suitable hydroxy C2 alkyl derivatives of cellulose are available in the marketplace from Dow under the trade name "Cellosize" and from Hercules under the trade name "Natrasol".

Preferred dosage levels are such that the in wash concentration of the 1-4 beta polysaccharide is 0.01-0.06 g/L. In typical European was conditions the dosage of a laundry product is 7 g/L in about 8-15 liters of water depending on the machine and load.

Preferably the level of polysaccharide is 0.1-3% wt on full formulated product, more preferably 0.2-0.8% wt. In this specification, all percentages are weight percentages unless otherwise stated. A typical product would contain 0.5% wt of the polysaccharide which would give an in use concentration of around 0.035 g/L.

The deformable, water-insoluble particles of a size in the range 0.05-0.5 microns are preferably a wax, more preferably a micro-crystalline wax. Suitable waxes comprise hydrocarbons which are either branched, or cyclic or a mixture of both. Typical chain lengths are C40-C50.

Particularly preferred particulate materials are elastic.

Hardness of the materials can be measured by ASTM D-1321 (at 25° C.). Typical values are 10-20.

Typically the particles are prepared by an emulsification method and therefore they can contain surfactant species.

Typical dosage levels of the particles (on wash liquor) are 0.001-0.5 g/L.

The melting point of suitable particulate materials for use in a domestic washing process (which may typically be performed at 40 Celsius) will typically be above 60 Celsius and preferably be 70-90 Celsius. It is however only important that the particles retain their particulate nature at the temperature of the wash. Typically, melting points will be below 85 Celsius, preferably below 65 Celsius.

Suitable particulate materials are available from Hercules under the trade name 'Paracol' and from Lubrizol under the trade name 'Thermol'.

DETAILED DESCRIPTION OF THE INVENTION

Carriers and Product Form:

The compositions of the invention will generally be used in conjunction with a textile compatible carrier.

In the context of the present invention the term "textile compatible carrier" includes a component which can assist in the interaction of the polymer with the textile. The carrier can also provide benefits in addition to those provided by the first component e.g. softening, cleaning etc. The carrier may be a detergent-active compound or a textile softener or conditioning compound or other suitable detergent or textile treatment agent. Many of these fall within the more general definition 'surfactant' as used herein. The surfactant may comprise the entire carrier or other, non-surfactant carrier materials may be present.

In a washing process, as part of a conventional textile washing product, such as a detergent composition, the textile-compatible carrier will typically be a detergent-active compound. Whereas, if the textile treatment product is a rinse conditioner, the textile-compatible carrier will be a textile softening and/or conditioning compound. These are described in further detail below.

The polymer is preferably used to treat the textile in the wash cycle of a laundering process.

The composition of the invention may be in the form of a liquid, solid (e.g. powder or tablet), a gel or paste, spray, stick or a foam or mousse. Examples include a soaking product, a rinse treatment (e.g. conditioner or finisher) or a main-wash product.

Liquid compositions may also include an agent which produces a pearlescent appearance, e.g. an organic pearlising compound such as ethylene glycol distearate, or inorganic pearlising pigments such as microfine mica or titanium dioxide ($TiO_2$) coated mica. Liquid compositions may be in the form of emulsions or emulsion precursors thereof.

Detergent Active Compounds:

If the composition of the present invention is itself in the form of a detergent composition, the textile-compatible carrier may be chosen from soap and non-soap anionic, cationic, nonionic, amphoteric and zwitterionic detergent active compounds, and mixtures thereof.

Many suitable detergent active compounds are available and are fully described in the literature, for example, in "Surface-Active Agents and Detergents", Volumes I and II, by Schwartz, Perry and Berch.

The preferred textile-compatible carriers that can be used are soaps and synthetic non-soap anionic and nonionic compounds.

Anionic surfactants are well-known to those skilled in the art. Examples include alkylbenzene sulphonates, particularly linear alkylbenzene sulphonates having an alkyl chain length of $C_8$-$C_{15}$; primary and secondary alkylsulphates, particularly $C_8$-$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

Cationic surfactants that may be used include quaternary ammonium salts of the general formula $R_1R_2R_3R_4N^+ X^-$ wherein the R groups are independently hydrocarbyl chains of $C_1$-$C_{22}$ length, typically alkyl, hydroxyalkyl or ethoxylated alkyl groups, and X is a solubilising cation (for example, compounds in which $R_1$ is a $C_8$-$C_{22}$ alkyl group, preferably a $C_8$-$C_{10}$ or $C_{12}$-$C_{14}$ alkyl group, $R_2$ is a methyl group, and $R_3$ and $R_4$, which may be the same or different, are methyl or hydroxyethyl groups); and cationic esters (for example, choline esters) and pyridinium salts.

The total quantity of detergent surfactant in the composition is suitably from 0.1 to 60 wt % e.g. 0.5-55 wt %, such as 5-50 wt %.

Preferably, the quantity of anionic surfactant (when present) is in the range of from 1 to 50% by weight of the total composition. More preferably, the quantity of anionic surfactant is in the range of from 3 to 35% by weight, e.g. 5 to 30% by weight.

Preferably, the quantity of nonionic surfactant (when present) is in the range of from 2 to 25% by weight, more preferably from 5 to 20% by weight.

Amphoteric surfactants may also be used, for example amine oxides or betaines.

Builders:

The compositions may suitably contain from 10 to 70%, preferably from 15 to 70% by weight, of detergency builder.

Preferably, the quantity of builder is in the range of from 15 to 50% by weight.

The detergent composition may contain as builder a crystalline aluminosilicate, preferably an alkali metal aluminosilicate, more preferably a sodium aluminosilicate.

The aluminosilicate may generally be incorporated in amounts of from 10 to 70% by weight (anhydrous basis), preferably from 25 to 50%. Aluminosilicates are materials having the general formula:

$$0.8\text{-}1.5\ M_2O.\ Al_2O_3.\ 0.8\text{-}6\ SiO_2$$

where M is a monovalent cation, preferably sodium. These materials contain some bound water and are required to have a calcium ion exchange capacity of at least 50 mg CaO/g. The preferred sodium aluminosilicates contain 1.5-3.5 $SiO_2$ units in the formula above. They can be prepared readily by reaction between sodium silicate and sodium aluminate, as amply described in the literature.

Alternatively, or additionally to the aluminosilicate builders, phosphate builders may be used.

Textile Softening and/or Conditioner Compounds:

If the composition of the present invention is in the form of a textile conditioner composition, the textile-compatible carrier will be a textile softening and/or conditioning compound (hereinafter referred to as "textile softening compound"), which may be a cationic or nonionic compound.

The softening and/or conditioning compounds may be water insoluble quaternary ammonium compounds. The compounds may be present in amounts of up to 8% by weight (based on the total amount of the composition) in which case the compositions are considered dilute, or at levels from 8% to about 50% by weight, in which case the compositions are considered concentrates.

Compositions suitable for delivery during the rinse cycle may also be delivered to the textile in the tumble dryer if used in a suitable form. Thus, another product form is a composition (for example, a paste) suitable for coating onto, and delivery from, a substrate e.g. a flexible sheet sponge or a suitable dispenser during a tumble dryer cycle.

Suitable cationic textile softening compounds are substantially water-insoluble quaternary ammonium materials comprising a single alkyl or alkenyl long chain having an average chain length greater than or equal to $C_{20}$. More preferably, softening compounds comprise a polar head group and two alkyl or alkenyl chains having an average chain length greater than or equal to $C_{14}$. Preferably the textile softening compounds have two, long-chain, alkyl or alkenyl chains each having an average chain length greater than or equal to $C_{16}$.

Most preferably at least 50% of the long chain alkyl or alkenyl groups have a chain length of $C_{18}$ or above. It is preferred if the long chain alkyl or alkenyl groups of the textile softening compound are predominantly linear.

Quaternary ammonium compounds having two long-chain aliphatic groups, for example, distearyldimethyl ammonium chloride and di(hardened tallow alkyl) dimethyl ammonium chloride, are widely used in commercially available rinse conditioner compositions. Other examples of these cationic compounds are to be found in "Surface-Active Agents and Detergents", Volumes I and II, by Schwartz, Perry and Berch. Any of the conventional types of such compounds may be used in the compositions of the present invention.

The textile softening compounds are preferably compounds that provide excellent softening, and are characterised by a chain melting Lβ to Lα transition temperature greater than 25° C., preferably greater than 35° C., most preferably greater than 45° C. This Lβ to Lα transition can be measured by DSC as defined in "Handbook of Lipid Bilayers", D Marsh, CRC Press, Boca Raton, Fla., 1990 (pages 137 and 337).

Substantially water-insoluble textile softening compounds are defined as textile softening compounds having a solubility of less than $1\times10^{-3}$ wt % in demineralised water at 20° C. Preferably the textile softening compounds have a solubility of less than $1\times10^{-4}$ wt %, more preferably less than $1\times10^{-8}$ to $1\times10^{-6}$ wt %.

Especially preferred are cationic textile softening compounds that are water-insoluble quaternary ammonium materials having two $C_{12\text{-}22}$ alkyl or alkenyl groups connected to the molecule via at least one ester link, preferably two ester links. Di(tallowoxyloxyethyl) dimethyl ammonium chloride and/or its hardened tallow analogue are especially preferred of the compounds of this type. Other preferred materials include 1,2-bis(hardened tallowoyloxy)-3-trimethylammonium propane chloride. Their methods of preparation are, for example, described in U.S. Pat. No. 4,137,180 (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride.

Other useful cationic softening agents are alkyl pyridinium salts and substituted imidazoline species. Also useful are primary, secondary and tertiary amines and the condensation products of fatty acids with alkylpolyamines.

The compositions may alternatively or additionally contain water-soluble cationic textile softeners, as described in GB 2 039 556B (Unilever).

The compositions may comprise a cationic textile softening compound and an oil, for example as disclosed in EP-A-0829531.

The compositions may alternatively or additionally contain nonionic textile softening agents such as lanolin and derivatives thereof.

Lecithins are also suitable softening compounds.

Nonionic softeners include Lβ phase forming sugar esters (as described in M Hato et al Langmuir 12, 1659, 1666, (1996)) and related materials such as glycerol monostearate or sorbitan esters. Often these materials are used in conjunction with cationic materials to assist deposition (see, for example, GB 2 202 244). Silicones are used in a similar way as a co-softener with a cationic softener in rinse treatments (see, for example, GB 1 549 180).

The compositions may also suitably contain a nonionic stabilising agent. Suitable nonionic stabilising agents are linear $C_8$ to $C_{22}$ alcohols alkoxylated with 10 to 20 moles of alkylene oxide, $C_{10}$ to $C_{20}$ alcohols, or mixtures thereof.

Advantageously the nonionic stabilising agent is a linear $C_8$ to $C_{22}$ alcohol alkoxylated with 10 to 20 moles of alkylene oxide. Preferably, the level of nonionic stabiliser is within the range from 0.1 to 10% by weight, more preferably from 0.5 to 5% by weight, most preferably from 1 to 4% by weight. The mole ratio of the quaternary ammonium compound and/or other cationic softening agent to the nonionic stabilising agent is suitably within the range from 40:1 to about 1:1, preferably within the range from 18:1 to about 3:1.

The composition can also contain fatty acids, for example $C_8$ to $C_{24}$ alkyl or alkenyl monocarboxylic acids or polymers thereof. Preferably saturated fatty acids are used, in particular, hardened tallow $C_{16}$ to $C_{18}$ fatty acids. Preferably the fatty acid is non-saponified, more preferably the fatty acid is free, for example oleic acid, lauric acid or tallow fatty acid. The level of fatty acid material is preferably more than 0.1% by weight, more preferably more than 0.2% by weight. Concentrated compositions may comprise from 0.5 to 20% by weight of fatty acid, more preferably 1% to 10% by weight. The weight ratio of quaternary ammonium material or other cationic softening agent to fatty acid material is preferably from 10:1 to 1:10.

Other Components

Compositions according to the invention may comprise soil release polymers such as block copolymers of polyethylene oxide and terephthalate.

Other optional ingredients include emulsifiers, electrolytes (for example, sodium chloride or calcium chloride) preferably in the range from 0.01 to 5% by weight, pH buffering agents, and perfumes (preferably from 0.1 to 5% by weight).

Further optional ingredients include non-aqueous solvents, perfume carriers, fluorescers, colourants, hydrotropes, antifoaming agents, enzymes, optical brightening agents, and opacifiers.

Suitable bleaches include peroxygen bleaches. Inorganic peroxygen bleaching agents, such as perborates and percarbonates are preferably combined with bleach activators. Where inorganic peroxygen bleaching agents are present the nonanoyloxybenzene sulphonate (NOBS) and tetra-acetyl ethylene diamine (TAED) activators are typical and preferred.

Suitable enzymes include proteases, amylases, lipases, cellulases, peroxidases and mixtures thereof.

In addition, compositions may comprise one or more of anti-shrinking agents, anti-wrinkle agents, anti-spotting agents, germicides, fungicides, anti-oxidants, UV absorbers (sunscreens), heavy metal sequestrants, chlorine scavengers, dye fixatives, anti-corrosion agents, drape imparting agents, antistatic agents and ironing aids. The lists of optional components are not intended to be exhaustive.

The preferred mode of delivery of the compositions of the invention is in the form of a fabric washing powder. These are typically dosed at around 7 g/liter, into 15-20 liters of wash water.

In order that the invention may be further and better understood it will be described below with reference to the following non-limiting examples.

EXAMPLES

Table 1 below shows delta E results (change in colour) from new. These are Quickwash™ experiments using 6 g/l Persil Original Non-Bio, ex Lever Bros UK (Spring 2004). Lower values of delta E indicate a reduction in the magnitude of the colour change as compared with higher values.

A Datacolor™ Spectraflash SF600+ reflectance spectrometer was calibrated using white tile and black trap standards prior to measurement of the reflectance over the wavelength range 400-720 nm on each fabric piece.

The test fabrics (red, green, black and blue woven cotton) were washed in a Quickwash™ apparatus using the following protocol.

| | |
|---|---|
| Apparatus | Raitech ™ Quickwash ™ Plus. |
| Powder | 6 g/L |
| Fabrics | One coloured fabric piece was place in each of the five compartments of the Quickwash ™. |

Wash Conditions

The Quickwash programme was executed as follows:

1. 30 second drain
2. Fill with 3 liters of 15° FH water at 40° C.
3. Machine paused and powder added
4. Programme resumed
5. Agitated for 15 minutes at 40° C.
6. Drain for 30 seconds
7. Fill with 3 liters of 15° FH water at 40° C.
8. Agitate for 5 minutes (Rinse)
9. Drain for 30 seconds
10. Dry at 4.0 bar for 1 minute
11. Dry at 3.5 bar for 1 minute
12. Dry at 3.0 bar for 2 minutes
13. Cool-down These steps were repeated five times. After the completion of the five washing and drying cycles the reflectance of each fabric was recorded at the same points using the calibrated spectrometer and the delta E value recorded. '95% c' values are the +/− limits of the confidence interval based on a statistical analysis of results.

TABLE 1

| | Delta E from new | | | | | | | |
|---|---|---|---|---|---|---|---|---|
| | mean Black | mean Red | mean Blue | mean Green | 95% c Black | 95% c Red | 95% c Blue | 95% c Green |
| 0.125 g/l Cellosize QP300 | 3.71 | 8.82 | 3.32 | 5.10 | 0.15 | 0.28 | 0.20 | 0.13 |
| 0.25 g/l Cellosize QP300 | 3.85 | 10.14 | 4.21 | 5.46 | 0.15 | 0.23 | 0.08 | 0.07 |
| 0.125 g/l Paracol 1324C | 4.50 | 9.83 | 3.33 | 5.93 | 0.14 | 0.25 | 0.13 | 0.09 |
| 0.25 g/l Paracol 1324C | 3.98 | 11.12 | 3.69 | 5.67 | 0.10 | 0.15 | 0.18 | 0.16 |
| 0.125 g/l QP300 + 0.125 g/l 1324C | 3.40 | 8.92 | 2.68 | 5.02 | 0.18 | 0.22 | 0.08 | 0.15 |

From the results it can be seen that the wax alone (Paracol 1324C ex. Hercules) is worse than HEC (Cellosize QP300, ex Dow), even when used at twice the level (0.25 g/l wax compared to 0.125 g/l HEC). However, when the two are used together, the benefit increases rather than decreases.

Table 2 below shows some further results using the black coloured fabric pieces only and the same experimental conditions as above. This time 'Delta L' is being measured (i.e. the change in luminance).

TABLE 2

| | Delta L from new (after five washes) | | | | | | |
|---|---|---|---|---|---|---|---|
| | Rep 1 Black | Rep 2 Black | Rep 3 Black | Rep 4 Black | Average Black | s.d. Black | 95% conf Black |
| Persil Non Bio | 5.09 | 5.86 | 6.72 | 4.80 | 5.62 | 0.86 | 0.84 |
| +0.25 g/l QP300 | 3.51 | 3.88 | 3.98 | | 3.79 | 0.25 | 0.28 |
| +0.25 g/l 1324C | 3.8 | 4.61 | 3.59 | | 4.00 | 0.54 | 0.61 |
| +0.125 g/l QP300 + 0.125 g/l 1324C | 2.91 | 2.79 | 3.40 | | 3.03 | 0.32 | 0.37 |

Again it can be seen that the greatest benefit (lowest change in luminance) is found when both the wax and the cellulose derivative are present and that the same amount in total of either of these materials taken alone shows less benefit.

The invention claimed is:

1. A method of treating fabrics with a wash liquor which comprises the step of contacting the fabrics with the wash liquor wherein the liquor includes a) a polysaccharide, b) deformable, water-insoluble particles of a size in the range 0.05-5 microns, and c) a textile compatible carrier which is a detergent-active compound chosen from soaps and synthetic non-soap anionic and non-ionic compounds, and, d) wherein the deformable water-insoluble particles are a wax, and wherein the particles are present at a level of 0.001-0.5 g/L on wash liquor.

2. A method according to claim 1 wherein the fabrics have a luminance (L*) less than 50.

3. A method according to claim 2 wherein the fabrics are black.

* * * * *